United States Patent [19]

Crawford et al.

[11] 4,201,410

[45] May 6, 1980

[54] RELEASE HOOK ASSEMBLIES

[75] Inventors: Henry Crawford, East Kilbride, Scotland; Alexander F. Jessiman, London, England

[73] Assignee: The Secretary of State for Industry in Her Britannic Majesty's Government of the United Kingdom of Great Britain and Northern Ireland, London, England

[21] Appl. No.: 894,296

[22] Filed: Apr. 7, 1978

[30] Foreign Application Priority Data

Apr. 6, 1977 [GB] United Kingdom ..... 14654/77

[51] Int. Cl.[2] ..... B66C 1/34

[52] U.S. Cl. ..... 294/83 R

[58] Field of Search ..... 294/83 R, 84, 83 AB, 294/82 R, 83 A, 66, 104; 24/241 R, 241 P, 241 PP

[56] References Cited

U.S. PATENT DOCUMENTS

| | | | |
|---|---|---|---|
| 3,762,757 | 10/1973 | Epstein | 294/83 R |
| 3,926,467 | 12/1975 | Crissy et al. | 294/83 R |

*Primary Examiner*—James B. Marbert

*Attorney, Agent, or Firm*—Pollock, Vande Sande and Priddy

[57] ABSTRACT

A release hook assembly comprising a pivoted hook retainable by a pivoted escapement member for closure of the assembly, a displaceable release device to engage the escapement member when retaining the hook, and a locking member to engage the release device for maintaining the assembly in the closed position, whereby in operation displacement of the locking member from the closed position allows subsequent displacement of the release device and consequent pivotal motion of the hook free from the escapement member.

7 Claims, 2 Drawing Figures

RELEASE HOOK ASSEMBLIES

This invention relates to release hook assemblies, and more particularly to release hook assemblies adapted for release when under load.

It is an object of the present invention to provide a release hook adapted for rapid, reliable release operation when under load.

According to the present invention, a release hook assembly comprises a pivoted hook retainable by a pivoted escapement member for closure of the assembly, a displaceable release device to engage the escapement member when retaining the hook, and a locking member to engage the release device for maintaining the assembly in the closed position, whereby in operation displacement of the locking member from the closed position allows subsequent displacement of the release device and consequent pivotal motion of the hook free from the escapement member.

The release device is preferably arranged for pivotal displacement about an axis. Conveniently, the release device comprises a pivoted lever fitted with a roller to engage the escapement member, the escapement member being formed with a curved surface to engage the roller when the assembly is in the closed position.

The escapement member is preferably of bifurcate construction to accommodate the heel of the hook therein, the heel of the hook being retainable within the bifurcations by a pin or other appropriate retaining means spanning the bifurcations.

The locking member is preferably a pivoted lever arranged for pivotal displacement, the lever being conveniently arranged to pass through a space within the release lever. Conveniently also, the locking member is formed with a shoulder portion to engage the release device for maintaining the assembly in the closed position.

The release hook assembly preferably includes respective cables attached to the release device and the locking member for displacement thereof from the closed position. Conveniently, the release hook assembly includes a pair of side plates between which the hook, escapement member, release device and locking member are arranged. Advantageously, the assembly includes a pivoted mousing link to permit hooking and inhibit unhooking when the hook is in the closed position.

Figure 1:
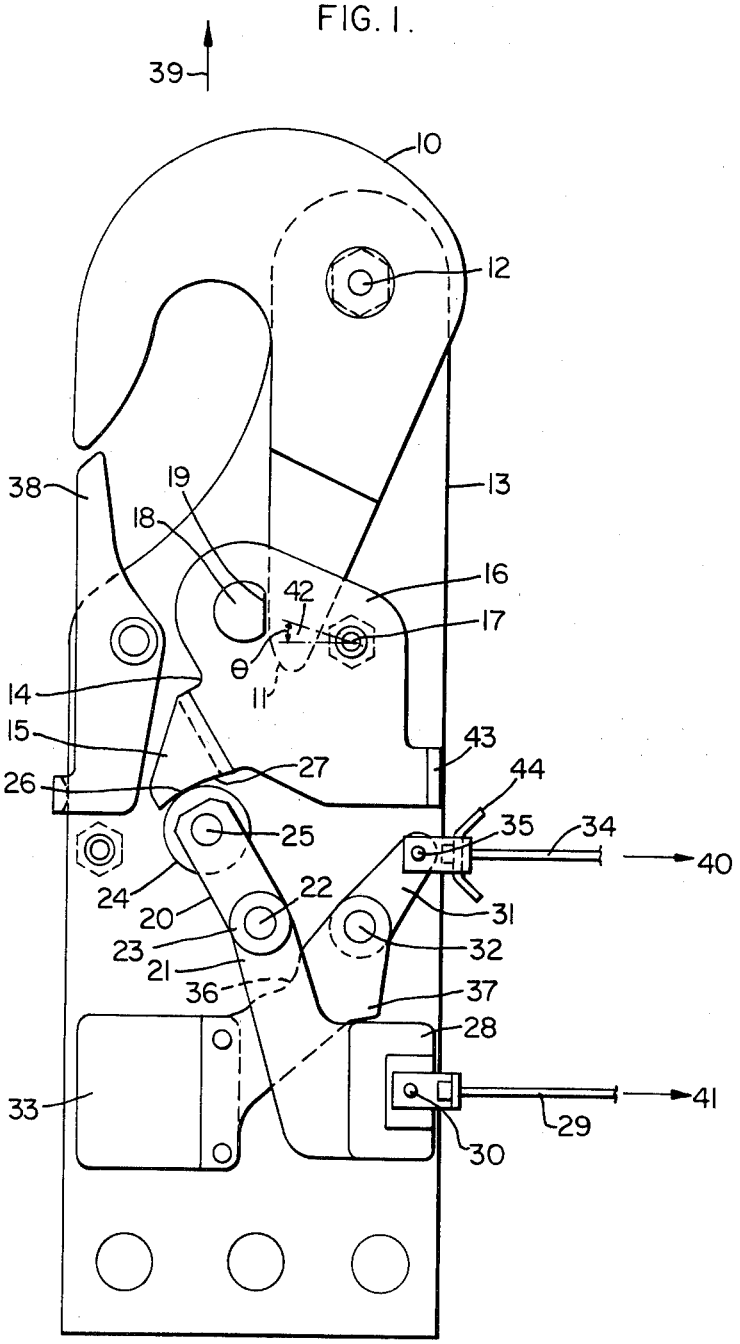
Figure 2:
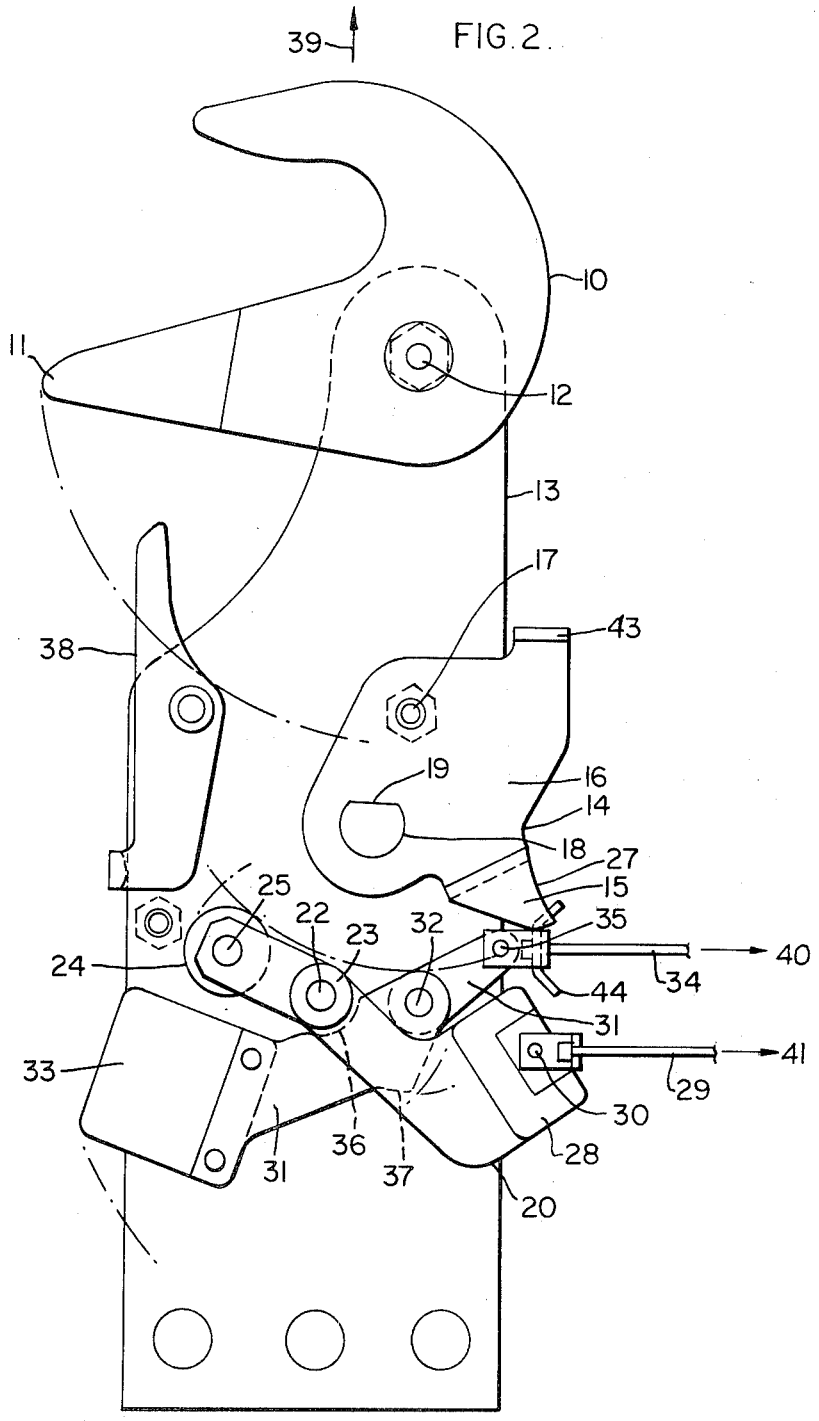

In order that the invention may be more fully understood, one embodiment thereof will now be described, by way of example only, with reference to the accompanying drawings, in which:

FIG. 1 shows a side-view of a release hook assembly of the invention in the closed position, and FIG. 2 shows the assembly of FIG. 1 in the open position.

FIGS. 1 and 2 show a release hook assembly of the invention, the hook being in the closed position in FIG. 1 and in the open position in FIG. 2. In both drawings the working parts are exposed for clarity. In FIG. 1, a hook 10 having a heel portion 11 is pivotally mounted about an axis 12 and is secured between sideplates 13.

The heel 11 of the hook 10 is retained in the closed condition by an escapement member 14. The escapement member 14 includes a heel portion 15 extending into bifurcate plate members 16. The plate members 16 are jointly pivotally mounted about an axis 17 secured between the sideplates 13. The escapement member 14 is fitted with an escapement pin 18 located between the plate members 16, the pin 18 having a flattened face 19 arranged to engage tangentially with the curved surface of the hook heel 11.

The heel portion 15 of the escapement member 14 engages a release device in the form of a lever 20 comprising parallel plate members 21. The release lever 20 is pivotally mounted about an axis 22 by means of a bush 23, and retains a roller 24 rotatably mounted on its axis 25. In the closed position, the roller 24 contacts a point 26 on a curved surface 27 formed on the escapement heel portion 15. The curved surface 27 is, in the closed position shown, radiused about the pivotal axis 22 of the release lever 20. The geometry of the escapement member 14 and the release lever 20 is arranged such that a straight line through the point of contact 26 passes perpendicularly through the axes 22 and 25.

The release lever 20 carries a counterweight 28, and a cable 29 is pivotally attached to the lever 20 and 30. A locking lever 31 is pivotally mounted about an axis 32 and extends between the parallel plate members 21 of the release lever 20. The locking lever 31 has a counterweight 33 and a cable 34 is pivotally attached to the lever 31 at 35. The locking lever is formed with a recess 36 complementary to the release lever bush 23, and also has a shoulder 37 to engage the release lever 20 in the closed position.

The release hook assembly is fitted with a pivotally mounted mousing link 38 allowing insertion within, and inhibiting escape from, the hook 10 when in the closed position.

Referring now also to FIG. 2, the operation of opening the closed hook assembly shown in FIG. 1 is as follows. The release operation takes place under a load producing a force on the hook 10 acting generally in the direction of the arrow 39. The opening of the hook 10 is initiated by pulling the locking lever cable 34 in the direction indicated by the arrow 40. This rotates the locking lever 31 clock-wise about its pivotal axis 32 so that its shoulder 37 ceases to engage the release lever 20 which is thereby freed. The locking lever 31 swings up until the recess 36 encompasses the release lever bush 23. The release lever cable 29 is then pulled in the direction of the arrow 41 to rotate the release lever 20 anticlockwise about its pivotal axis 22. In consequence, the roller 24 rolls along the radiused curved surface 27 until the escapement heel 15 is cleared. When clearance occurs, the escapement member 14 is urged anticlockwise under the force of the hook heel 11 on the escapement pin 18.

The anticlockwise force on the escapement member 14 exerted by the hook heel 11 under load is resisted by friction between the hook heel 11 and the flattened face 19 of the escapement pin 18. The condition for the hook 10 to rotate free of the escapement member 14 is that the coefficient of friction is less than tan $\theta$, where $\theta$ is the angle 42 between two intersecting lines through the pivotal axis 17 of the escapement member 14, one of the lines passing through the point of contact of the hook heel 11 and the escapement pin 18 and the other line being perpendicular to the hook load direction indicated by the arrow 39. To overcome friction, $\theta$ is arranged to be 17°.

Overcoming friction, the hook 10 pivots clockwise as the escapement member 14 pivots anticlockwise until the release hook assembly reaches the fully open position shown in FIG. 2.

A closed release lever assembly of the invention can only be opened by two sequential operations, displacement of the locking lever 31 and subsequent displacement of the release lever 20. Accidental operation is therefore extremely unlikely, which is a very important feature of the invention. One particular application of the invention lies in lifeboat suspensions from ship's falls, oil rigs and the like, in which premature operation might have very severe consequences. In particular, premature operation might result in a loaded lifeboat falling a hundred feet or so to the sea beneath.

The illustrated embodiment is designed so that the release lever 20 experiences no turning moment when the hook is closed and under load. In the closed position, a line through the roller axis 25 passes through the release lever pivotal axis 22 and through the point of contact of the roller 24 and the escapement curved surface 27. Since the closed position the curved surface 27 is radiused about the axis 22, this collinear relationship is preserved for small displacements and all forces of reaction act along the line defined. Any rotational tendency of the escapement urged by the loaded hook is counteracted by a reaction at the release lever bush 23 acting along the line defined. Loading of the assembly therefore produces no turning moment on the release lever 20. Consequently, operation of the locking lever cable 34 does not result in the release lever moving prior to its cable 29 being pulled.

Excluding minor frictional contributions, the force required to open the illustrated assembly is independent of the load on the hook, and is determined largely by the moments of the two counterweights about their prvots. It has been found that slightly built personnel can easily operate the release cables with the hook under a load of several tons. The time for release to occur after the instant of operation is typically a few milliseconds. Two linked release hook assemblies of the invention used in a loaded suspension will therefore release simultaneously for all practical purposes.

Resetting of the hook is facilitated by the provision of a handle portion 43 on the escapement member 14, and a finger plate 44 on the attachment between the cable 34 and the locking lever 31. The escapement member 14 is shaped such that the handle portion 43 is flush with one edge of the side plates 13 of the hook assembly when the hook 10 is set as shown in FIG. 1.

We claim:

1. A release hook assembly comprising a frame, a hook mounted on the frame for pivotal movement relative thereto, an escapement member pivotally mounted on the frame so as to be able to retain the hook for closure of the assembly, a release device pivotally mounted on the frame, said release device engaging the escapement member so as to maintain the assembly in the closed position, said escapement member and said release device being so formed and disposed that in operation the escapement member exerts substantially no turning moment on the release device, and a locking member pivotally mounted on the frame so as to engage the release device, whereby displacement of the locking member from engagement with the release device allows subsequent displacement of the release device and consequent pivotal motion of the hook free from the escapement member.

2. A release hook assembly as claimed in claim 1 wherein the release device comprises a lever fitted with a roller to engage the escapement member, the escapement member being formed with a curved surface to engage the roller when the assembly is in the closed position, the center of curvature of the curved surface lying on the pivotal axis of the release lever.

3. A release hook assembly as claimed in claim 1 wherein the escapement member is of bifurcate construction to accommodate the heel of the hook therein, the heel of the hook being retainable within the bifurcations by a pin spanning the bifurcations.

4. A release hook assembly as claimed in claim 3 wherein the locking member is a lever pivotally mounted on the frame, the lever being arranged to pass through a space within the release device and being formed with a shoulder portion to engage the release device for maintaining the assembly in the closed position.

5. A release hook assembly as claimed in claim 4 wherein separately operable cables are attached to the locking member and to the release device respectively for individual sequential displacement thereof from their respective closed positions.

6. A release hook assembly as claimed in claim 5 wherein a mousing link is pivotally mounted on the frame to permit hooking and inhibit unhooking when the hook is in the closed position.

7. A release hook assembly as claimed in claim 1 wherein the frame comprises two side plates with the hook, escapement member, release device and locking member mounted therebetween.

* * * * *